United States Patent [19]

Jans

[11] Patent Number: 4,974,883

[45] Date of Patent: Dec. 4, 1990

[54] LATCH DEVICE WITH A TILTABLE FACE PLATE AND A SELECTABLE PRIVACY LOCK

[75] Inventor: Franz W. Jans, Roedermark, Fed. Rep. of Germany

[73] Assignee: Armaturen & Presswerk GmbH, Roedermark, Fed. Rep. of Germany

[21] Appl. No.: 392,564

[22] Filed: Aug. 11, 1989

[51] Int. Cl.[5] ..... E05C 1/16

[52] U.S. Cl. ..... 292/169; 292/169.14; 70/450

[58] Field of Search ..... 292/169, 169.12, 169.14, 292/169.15, 169.16, 169.17, 169.18, 169.21, 170, 173, 165, 336.5, DIG. 52, DIG. 77; 70/450

[56] References Cited

U.S. PATENT DOCUMENTS

| | | | |
|---|---|---|---|
| 2,263,477 | 11/1941 | Voight | 292/169.18 |
| 2,386,868 | 10/1945 | Karczewski | 292/169.16 |
| 2,497,189 | 2/1950 | Shaffer | 70/450 |
| 2,593,573 | 4/1952 | Kulbersh | 292/169.16 |
| 2,605,124 | 7/1952 | Hillgren | 292/359 |
| 2,743,600 | 5/1956 | Heyer | 292/169.16 |
| 2,980,463 | 4/1961 | Russell et al. | 70/450 X |
| 3,197,247 | 7/1965 | Russell | 292/337 |
| 3,498,660 | 3/1970 | James | 292/173 |
| 4,108,482 | 8/1978 | Dietrich et al. | 292/169.16 X |
| 4,453,753 | 6/1984 | Fayerman et al. | 292/359 X |
| 4,575,137 | 3/1986 | Jans | 292/169.14 |
| 4,852,918 | 8/1989 | Allen | 292/169 |
| 4,871,202 | 10/1989 | Friedrichs et al. | 292/169 |

FOREIGN PATENT DOCUMENTS

| | | | |
|---|---|---|---|
| 1181420 | 2/1970 | United Kingdom | 292/169 |

*Primary Examiner*—Eric K. Nicholson
*Attorney, Agent, or Firm*—H. Michael Brucker

[57] ABSTRACT

A latch device including a latch element, latch element moving means for moving the latch element including a transmission arm and two relatively movable cam elements, and means for moving the transmission arm relative to the cam elements to cause selective engagement between the transmission arm and lobes of either or both of said cam elements.

8 Claims, 4 Drawing Sheets

LATCH DEVICE WITH A TILTABLE FACE PLATE AND A SELECTABLE PRIVACY LOCK

TECHNICAL FIELD

This invention relates to an improved latch device for doors. More particularly, the invention is directed to a latch device which is relatively simple and compact yet highly versatile and efficient. Despite its compact nature the device incorporates structure which allows the latch element thereof to be fully retracted with only a slight rotation by a lever handle or doorknob operatively associated therewith.

BACKGROUND ART

Lever handle and doorknob actuating latch devices are, of course, well known mechanisms. Conventional latch devices, however, suffer from a number of inherent drawbacks, not the least of which is the requirement that a lever handle or doorknob associated therewith be turned in the order of 80 degrees or so to fully retract the movable latch element of the device so that a door may be opened.

While it is considered advantageous to effect latch withdrawal with a lesser degree of knob or lever handle rotation, prior art mechanisms for accomplishing this end have been characterized by their relatively large size and high degree of complexity. Prior art latch devices become even more complex and bulky when they incorporate other features deemed desirable such as privacy locking or adaptation to either left-hand or right-hand use.

DISCLOSURE OF INVENTION

The present invention relates to a latch device characterized by relative simplicity and compact size. Despite these characteristics the latch device disclosed herein operates in a highly efficient manner and lends itself to use in a variety of environments.

More specifically, the latch device of the present invention incorporates a novel combination of structural elements which enable the latch element of the device to be fully retracted (in the order of ½ inch or so) with only a very small rotational displacement of a latch handle or other manually manipulable element, such as a doorknob, utilized in conjunction with the device.

Another highly desirable feature of the latch device of the present invention is its ability to be utilized as a passage latch actuatable from both sides of the door with which it is associated or, alternatively, as a privacy locking system which is readily selectively adjustable by the operator to permit handle or doorknob actuation from only on side of the door. By making a slight adjustment in the latch device the side of the door with which the privacy locking system is applicable is readily changed.

Yet another desirable feature of the latch device disclosed herein is a securement plate which can be tilted relative to the latch device housing. Such feature enables the latch device to be utilized in connection with doors beveled at the ends thereof. The bevel of a door will be automatically compensated for with the arrangement of this invention.

Finally, the present latch device can be employed for either right or left hand operation. This change can be effected without removing the latch device operating structure from its housing or for that matter removing the housing from the door with which it is associated.

Other features, advantages, and objects of the present invention will become apparent with reference to the following detailed description and accompanying drawings.

BEST MODE FOR CARRYING OUT THE INVENTION

Figure 1A:
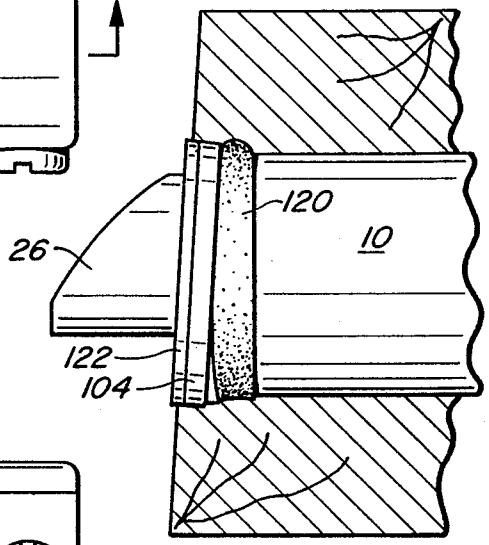
FIG. 1A is a view similar to that of FIG. 1 but showing only a portion of the latch device and such latch device installed on a beveled edge door.

Referring now to the drawings, a latch device constructed in accordance with the teachings of the present invention is illustrated and includes a housing 10 defining an interior 12. An opening 14 is disposed at one end of the housing and communicates with the housing interior.

The housing is comprised of two housing segments 16, 18 secured together at one end thereof by a screw 20 which has threads engaging those in housing segment 16.

A latch element 22 is disposed in housing interior 12 and includes a latch body 24 and a latch head 26. As is conventional, the latch head includes a generally tapered surface 28 and a substantially flat abutment surface 30. The latch head is enlarged as at 32 and a circular-shaped boss 34 projects therefrom. Boss 34 is rotatably disposed within a recess 36 of generally corresponding configuration formed in latch body 24. Thus, the latch head 26, unless otherwise restrained, is freely rotatable relative to the latch body.

The latch body 24 additionally comprises an extension 38 defining a generally rectangular opening 40. Extension 38 is curved where it meets housing 10 so that it generally conforms to the curvature of the housing wall.

Figure 2:
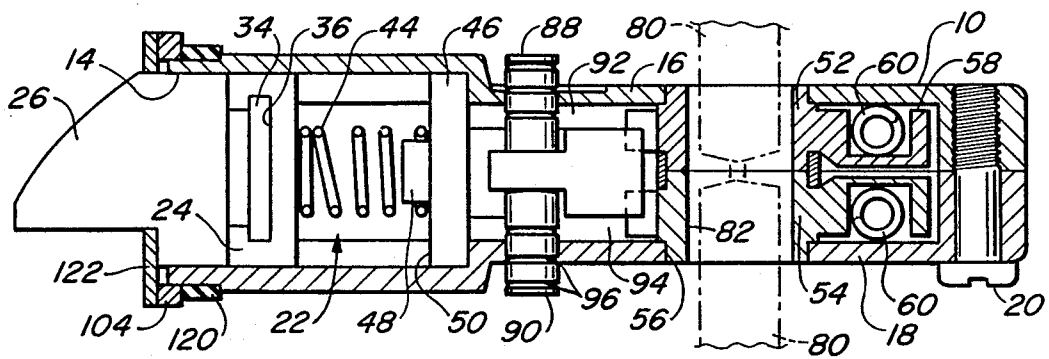
FIG. 2 is a cross-sectional view taken along the line 2—2 of FIG. 3.
Figure 4:
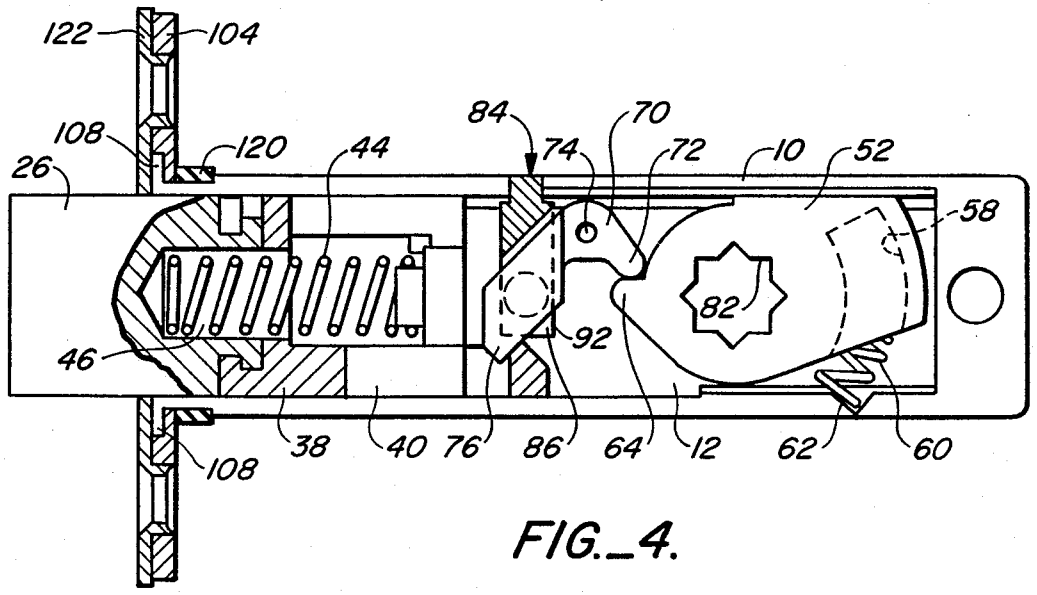
FIG. 4 is a partial, side sectional view taken along line 4—4 of FIG.1.
Figure 2A:
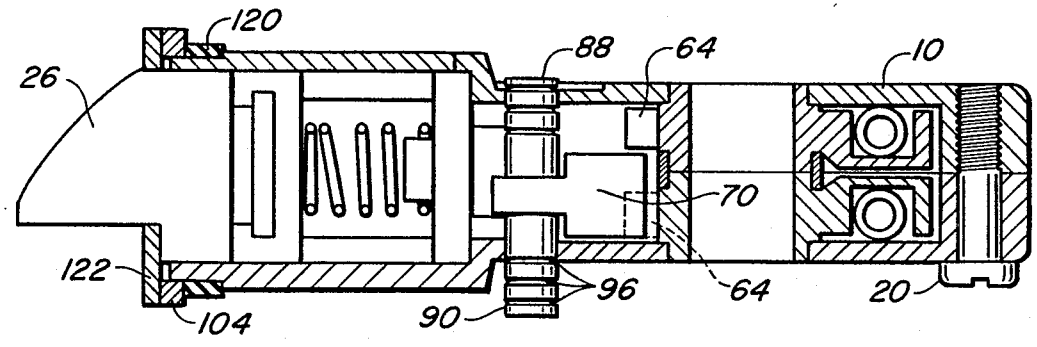
FIGS. 2A and 2B are views similar to that of FIG. 2 but illustrating selected components of the latch device in two alternate positions.
Figure 2B:
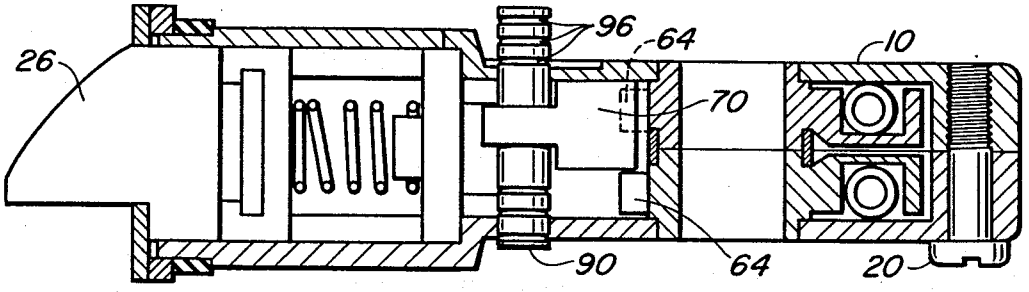
Figure 4A:
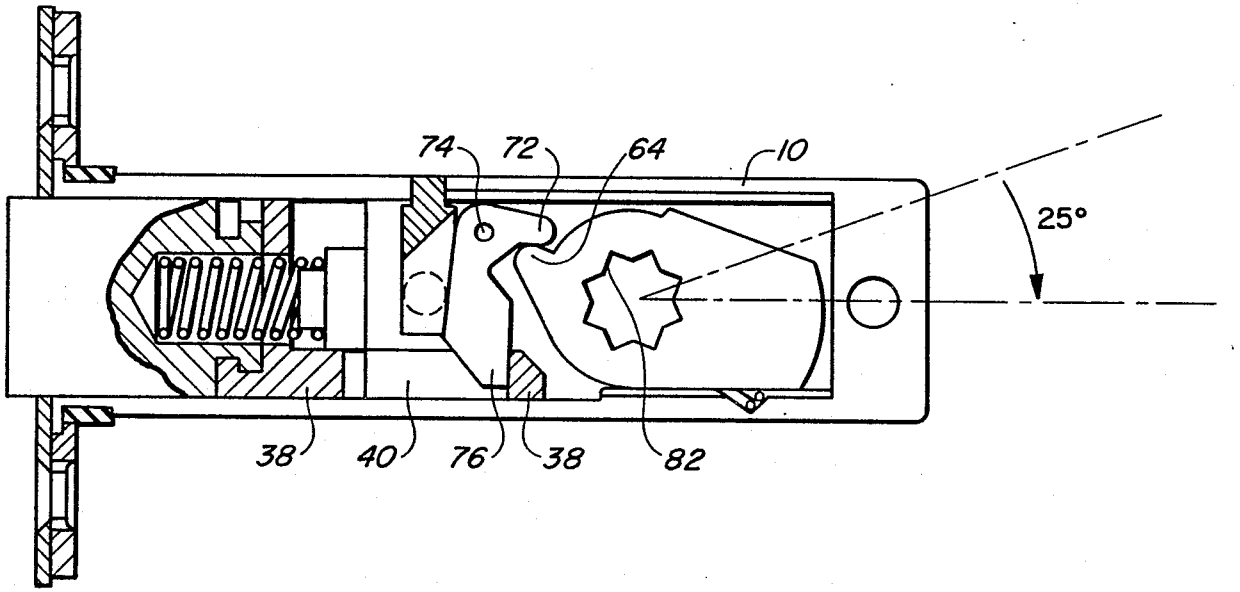
FIG. 4A is a view similar to FIG. 4 but illustrating the latch device latch element in a retracted position.

A coil compression spring 44 is disposed in a recess formed in the latch body 24. The other end of spring 44 engages wall member 46 and surrounds a circular-shaped projection 48 integral with the wall member. As may perhaps best be seen with reference to FIGS. 2, 2A and 2B, wall member 46 is prevented from moving toward the right as viewed in those figures because it is in engagement with peripherally extending abutment surface 50 defined by the housing. Spring 44 continuously urges the latch element 22 to the left as shown in FIGS. 2, 2A and 2B. The latch element is linearly reciprocatably moveable relative to housing 10 between an extended position whereat the head projects from the housing interior through opening 14 and a retracted position (shown in FIG. 4A) whereat the head is substantially completely retracted in the housing interior.

Means is operatively associated with the latch element for moving the latch element from the extended position to the retracted position. The latch element moving means includes cam means rotatably mounted relative to the housing and adapted to be rotated by actuator means accessible outside the housing. In particular, the cam means includes two relatively moveable cam elements 52, 54 disposed side by side within the housing. The cam elements each includes a round boss 56 which projects through a corresponding hole formed in one of housing segments 16, 18 whereby the cam elements are maintained in position and yet are rotatable to a degree within the housing.

Each cam element defines a channel 58, the channels 58 being curved and accommodating therein double-ended coil compression springs 60. One end of each coil compression spring engages an indent 62 formed in the housing wall. With specific reference to FIG. 4, it will be seen that cam element 52 is continuously biased by its associated spring 60 in a counter clockwise direction as viewed in that figure. The same, of course, holds true for cam element 54. Engagement between the cam elements and the wall of the housing limits such rotation and springs 60 are always maintained under compression.

Each cam element includes a lobe 64 engageable with a transmission arm 70. More specifically, the lobes 64 are engageable with a first projection 72 of said transmission arm. The transmission arm 70 is pivotally mounted on a pin 74 which extends between support recesses formed at spaced locations in the housing wall.

Transmission arm 70 also includes a second projection 76 which is located in opening 40 and engages extension 38 of latch body 24. Again making specific reference to FIG. 4, clockwise rotation of a cam element having its lobe 64 in engagement with the first projection 72 causes the transmission arm 70 to rotate in a counter clockwise direction. This action causes the latch element 22 to move toward the right against the compression of spring 44 and retract the latch element to the position illustrated in FIG. 4A.

With the arrangement illustrated, the cam means and transmission arm cooperate to retract the latch element in the order of at least about ½ inch from its extended position to its retracted position upon rotation of the cam means in the order of about 25 degrees. This is to be compared with conventional approaches wherein rotation of 80 degrees or even more by an associated door handle or knob is required to effect a retraction of this magnitude.

In FIG. 2, a portion of a shaft 80 is shown in phantom and such shaft projects completely through the housing 10, passing through apertures 82 formed in the cam elements at the location of bosses 56. It will be appreciated that the shaft 80 has attached at the ends thereof a manually manipulable element such as lever handles or doorknobs. If the shaft 80 is of the type which may be rotated in its entirety by either of the manually manipulable elements, either will rotate both cam elements. Thus, the disclosed latch device functions as a passage latch permitting the latch device to be operated from both sides of the door On the other hand, shaft 80 may be comprised of two relatively rotatable shaft components connected together by a connector which allows the shaft components to b individually rotated by their respective associated knobs or levers. A shaft of this type, which is split into two parts capable of independent movement, is known in the prior art and will not be described in detail.

When transmission arm 70 is in the position illustrated in FIG. 2, there is engagement between the lobes 64 of both cam elements 52, 54 and first projection 72 of the transmission arm. Thus, rotation of either or both of the cam elements 52, 54 by shaft 80 will result in pivoting of the transmission arm and retraction of the latch element 22. If, however, a shaft 80 incorporates two relatively rotatable shaft components as referred to above, the latch device can be readily adjusted to permit latch element retraction by either of the cam elements to the exclusion of the other. In other words, the latch device has a built-in privacy locking feature. This will now be described.

Disposed immediately adjacent to transmission arm 70 is a control member 84 including a saddle 86 and spindles 88, 90 projecting from opposed sides of the saddle. The saddle 86 includes two legs 92, 94. Second projection 76 of transmission arm 70 is disposed between the two legs.

It will be appreciated that endwise movement of spindles 88, 90 causes a corresponding lateral movement of the saddle 86 and the transmission arm 70 FIGS. 2A and 2B illustrate such action. In FIG. 2A the saddle and transmission arm have been displaced in the direction of spindle 90. When the latch device is in the condition illustrated in this figure the first projection 72 of the transmission arm is in engagement with only one cam element lobe 64, i.e. lobe 64 of cam element 54. Thus, rotation of cam element 54 will cause retraction of the latch element 22 but rotation of ca element 52 will not.

Just the opposite condition exists when the latch device components are in the positions illustrated in FIG. 2B. In this situation the saddle and transmission arm have been displaced in the direction of spindle 88 and first projection 72 is engaged only by the lobe on cam element 52, and only cam element 52 is effective to cause retraction of the latch element.

Figure 3:
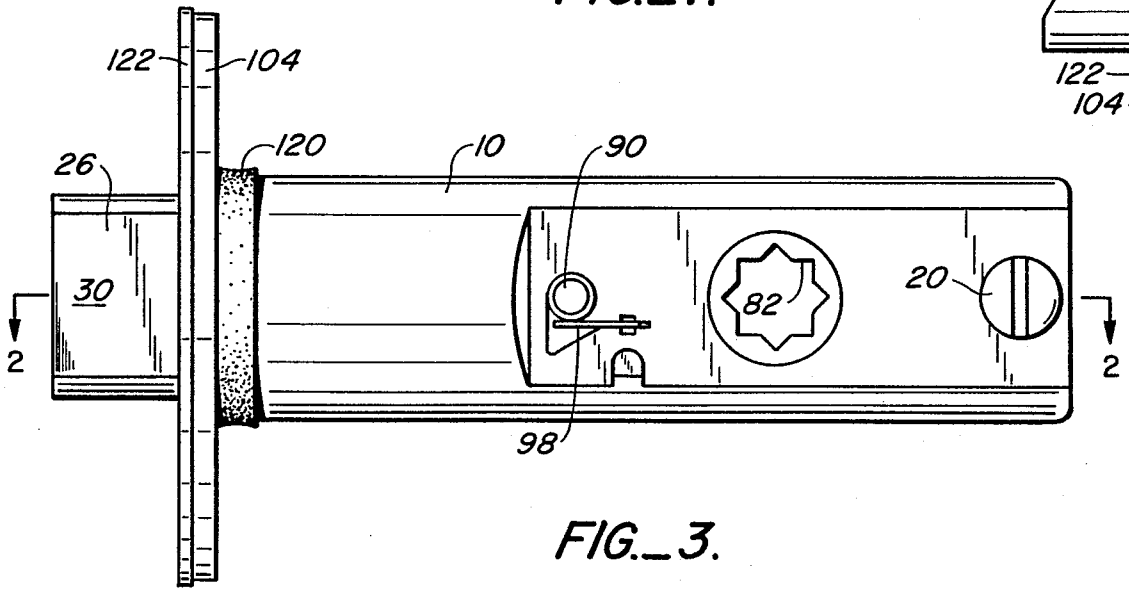
FIG. 3 is a side elevation view of the preferred embodiment of the latch device.

It should be noted that a series of grooves are formed at the ends of lobe spindle 88 and spindle 90. These grooves are designated by reference numeral 96. As may perhaps best be seen with reference to FIG. 3, a detent element in the form of a resilient pin 98 is secured to housing 10 adjacent to the aperture formed in housing 10 through which spindle 88 projects. Endwise pressure exerted upon the spindle will cause the spindle to move relative to the resilient pin; however, the pin will maintain the spindle and thus the rest of the control member in position when such endwise pressure is not exerted. If desired, a resilient pin may also be in operative relationship with spindle 90. The saddle 86 is prevented from rotating about the common axis of spindles 88, 90 by a guide 100 which projects through a slot 102 formed in the housing. This maY best be seen with reference to FIG. 1.

The illustrated embodiment of the latch device additionally includes a securement plate 104 positioned on the housing adjacent opening 14. Means is provided for attaching the securement plate to the housing in such a manner that the securement plate is tiltable relative to the housing to accommodate the bevel of a door end.

Figure 5:
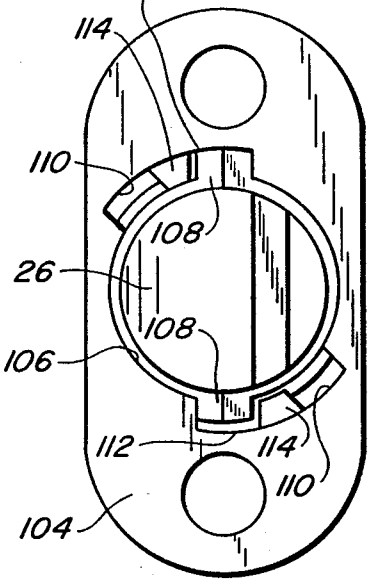
FIG. 5 is a front elevation view of the latch device of the present invention but with the face plate thereof removed.
Figure 6:
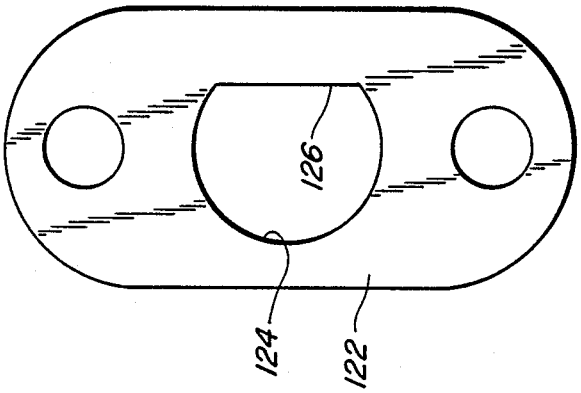
FIG. 6 is a front elevation view of the latch device face plate.

As may perhaps best be seen with reference to FIG. 5, securement plate 104 has a relatively large aperture 106 formed therein. The aperture 106 is adapted to receive the end of housing 10 having opening 14 and to secure together the housing segments 16, 18 at such end. The housing segments 16, 18 have tabs 108 projecting therefrom. For the securement plate 104 to be positioned in place with respect to the housing, the tabs 108 must be aligned with slots 110 formed in the securement plate and communicating with aperture 106. The securement plate and housing are then rotated with respect to one another to bring the tabs into position on ledges 112 recessed into the securement plate adjacent the slots 110. Preferably, but not necessarily, the ledges or recesses have raised portions 114 immediately adjacent to the slots whereby the tabs 108 will be locked into position.

Figure 1:
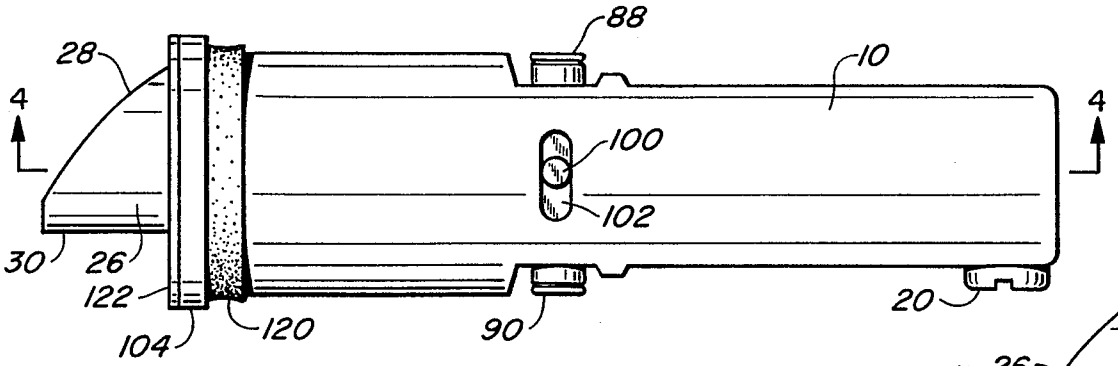
FIG. 1 is a plan view of a latch device constructed in accordance with the teachings of the present invention.

A washer or ring 120 formed of resilient material such as rubber is positioned in a peripherally extending groove formed in housing 10 adjacent opening 14. The securement plate is tiltable or canted relative to the housing 10 upon application of suitable forces thereto. This feature results in the securement plate and housing automatically and readily adjusting relative to one another when the latch device is employed with door having a beveled end. FIG. 1A provides an illustration of this selfadjusting feature. The ring 120 also continuously urges the securement plate outwardly so that the securement plate bears against tabs 108.

As described above, the latch head 26 is rotatable relative to latch body 24. For the latch head to be properly positioned relative to the remainder of the latch device, a face plate 122 is provided. Face place 122 defines an aperture 124 through which the latch head extends when the latch element is in its extended position. The aperture 124 has a configuration generally corresponding to the cross-sectional configuration of the latch head. In other words, the aperture 124 includes a straight segment 126 which corresponds to the flat abutment surface 30 of the latch head.

The flat abutment surface must be in a position corresponding to the location of straight aperture segment 126 or the latch head will not pass through the aperture. By moving the face plate 122 one hundred eighty degrees the straight aperture segment 126 will be disposed on either the left or the right as required by the particular door with which the latch device is employed. Both the face plate and the securement plate have screw holes formed therein which are aligned during installation on a door.

What is claimed is:

1. A latch device comprising in combination:

a housing defining an interior and an opening at one end of said housing communicating with said interior;

a latch element disposed in said housing interior and including a latch body and a latch head connected to said latch body, said latch element being linearly reciprocatably movable relative to said housing between an extended position wherein said head projects from said housing interior through said opening and a retracted position wherein said head is substantially completely retracted in said housing interior;

means operatively associated with said latch element for moving said latch element from said extended position to said retracted position, said latch element having means including cam means rotatably mounted relative to said housing and adapted to be rotated by actuator means accessible outside said housing and a transmission arm pivotally mounted on said housing within said interior and having spaced first and second projections, said first projection engaging said cam means and said second projection engaging said latch element, said transmission arm pivoting in response to rotation of said cam means to effect linear movement of said latch element from said extended position to said retracted position, said cam means including two relatively movable cam elements disposed side-by-side within said housing, each said cam element including a lobe engageable with said first projection; and means for moving said transmission arm relative to the cam elements to cause selective engagement between the first projection and the lobes of either or both of said cam elements, said latch element being movable from said extended position to said retracted position only upon rotation of a cam element having the lobe thereof in engagement with said transmission arm first projection, said transmission arm moving means comprising a movable control member engageable with said transmission arm to move said transmission arm to a preselected one of a number of locations in said housing and manually engageable means operatively associated with said control member to effect manual movement of the control member and the transmission arm.

2. The latch device according to claim 1 wherein said cam means and said transmission arm cooperate to retract said latch element in the order of at least about one-half inch from said extended position to said retracted position upon rotation of said cam means in the order of about twenty-five degrees.

3. The latch device according to claim 1 additionally comprising a securement plate positioned on said housing adjacent said housing opening and means for attaching said securement plate to said housing, said housing defining a peripherally extending groove adjacent said opening thereof, and said latch device further comprising a washer formed of resilient material disposed in said groove and engaging said securement plate, said washer compressing to permit said securement plate to tilt relative to said housing to accommodate the bevel of a door.

4. The latch device according to claim 3 wherein said housing is comprised of a plurality of housing segments and said securement plate encompasses said housing segments and secures them together, said housing segments including tabs projecting therefrom and said securement plate defining recesses for accommodating said tabs, said resilient washer cooperating with said housing segments and said securement plate to continuously urge said tabs against said securement plate and maintain said tabs in said recesses when said washer is compressed.

5. The latch device according to claim 1 wherein said manually engageable means comprises at least one support member extending from said control member through said housing to support said control member.

6. The latch device according to claim 5 including locking means for releasably retaining said control member at said preselected locations.

7. The latch device according to claim 1 wherein said control member includes a saddle having legs, said transmission arm disposed between the legs.

8. A latch device comprising in combination:

a housing defining an interior and an opening at one end of said housing communicating with said interior;

a latch element disposed in said housing interior and including a latch body and a latch head connected to said latch body, said latch element being linearly reciprocatably movable relative to said housing between an extended position wherein said head projects from said housing interior through said opening and a retracted position wherein said head is substantially completely retracted in said housing interior;

means operatively associated with said latch element for moving said latch element from said extended position to said retracted position;

a securement plate positioned on said housing adjacent to said housing opening; and means for attaching said securement plate to said housing, said housing defining a peripherally extending groove adjacent said opening thereof and said latch device further comprising a washer formed of resilient material disposed in said groove and engaging said securement plate when said securement plate is attached to said housing, said washer compressing to permit said securement plate to tilt relative to said housing to accommodate the bevel of a door.

* * * * *